US008534672B2

(12) United States Patent
Brune

(10) Patent No.: US 8,534,672 B2
(45) Date of Patent: Sep. 17, 2013

(54) SELF RESETTING TARGET APPARATUS

(75) Inventor: Thomas M. Brune, Highland Heights, KY (US)

(73) Assignee: Challenge Targets, LLC, Fort Thomas, KY (US)

( * ) Notice: Subject to any disclaimer, the term of this patent is extended or adjusted under 35 U.S.C. 154(b) by 329 days.

(21) Appl. No.: 13/009,338

(22) Filed: Jan. 19, 2011

(65) Prior Publication Data

US 2011/0175293 A1 Jul. 21, 2011

Related U.S. Application Data

(60) Provisional application No. 61/296,060, filed on Jan. 19, 2010.

(51) Int. Cl.
*F41J 7/04* (2006.01)
*F41J 7/06* (2006.01)

(52) U.S. Cl.
USPC ..... 273/406; 273/369; 273/392

(58) Field of Classification Search
USPC ..... 273/390–392, 403–410, 369, 370; 482/85; 472/100–102; 446/325, 326; 297/261.1
See application file for complete search history.

(56) References Cited

U.S. PATENT DOCUMENTS

| | | | | | |
|---|---|---|---|---|---|
| 1,328,344 | A * | 1/1920 | Smolens | 273/392 |
| 1,424,632 | A * | 8/1922 | Fenton | 273/392 |
| 3,814,429 | A * | 6/1974 | Lienhard | 273/368 |
| 4,232,867 | A * | 11/1980 | Tate, Sr. | 273/406 |
| 4,524,976 | A * | 6/1985 | Seitz et al. | 273/388 |
| 4,714,256 | A * | 12/1987 | Mosser | 273/392 |
| 4,773,652 | A * | 9/1988 | Mosser | 273/392 |
| 4,807,888 | A * | 2/1989 | Pidde et al. | 273/392 |
| 4,911,453 | A * | 3/1990 | Essex et al. | 273/359 |
| 5,240,258 | A * | 8/1993 | Bateman | 273/392 |
| 5,403,017 | A * | 4/1995 | Doss et al. | 273/372 |
| 5,433,451 | A * | 7/1995 | De Vries | 273/392 |
| 5,695,196 | A * | 12/1997 | Yanosky | 273/406 |
| 7,543,820 | B2 * | 6/2009 | King | 273/390 |
| 7,735,832 | B2 * | 6/2010 | Bliehall | 273/393 |
| 2011/0074110 | A1 * | 3/2011 | Markley | 273/392 |

OTHER PUBLICATIONS

Pro Plate Target Systems Website, http://www.mingusmetal.com/ProPlate/, date visited: Apr. 12, 2011, 28 pages.

* cited by examiner

*Primary Examiner* — Mark Graham
(74) *Attorney, Agent, or Firm* — Wood Herron & Evans, LLP

(57) ABSTRACT

Describe herein is a target apparatus that includes a base with a flat surface and a rocker assembly. The rocker assembly includes a curved surface operatively disposed in rolling engagement with the flat surface. The rocker assembly also includes a target support that is configured for supporting a target thereon. The rocker assembly rolls on the flat surface in a first direction between an upright position and a lowered position. The rocker assembly has a weight sufficient to return the rocker assembly to the upright position from the lowered position. The target apparatus may be configured such that a target mounted on the target support moves in a direction toward or away from the front of the target apparatus or in a direction perpendicular to a direction that runs from the back of the target apparatus to the front of the target apparatus.

20 Claims, 11 Drawing Sheets

SELF RESETTING TARGET APPARATUS

RELATED APPLICATION

This application claims the benefit of U.S. Provisional Application Ser. No. 61/296,060, filed Jan. 19, 2010, the disclosure of which is expressly incorporated by reference herein in its entirety.

FIELD OF THE INVENTION

This invention relates to reactive and moving targets for firearms practice and recreational shooting.

BACKGROUND OF THE INVENTION

There are a variety of shooting targets on the market that are designed to implement a single, specific type of training exercise or target function. For example, some targets are reactive and move when hit to provide shooter feedback. Other targets create movement through a swinging pendulum motion. There are targets that create random movement using motors and computer logic. Other products are designed so the target is concealed and swings, turns, or pops-up into view by remote control.

There are a variety of reactive steel, resetting targets on the market. Many such products use a spring to return the target to the upright position after being knocked toward the horizontal by impact pressure or bullet. When the target is hit and moves toward to the horizontal position, spring tension increases. Depending on the ammunition used, these targets often do not reach the full horizontal position before resetting.

The visual response with a spring resetting target is very quick and uneven. Although the springs can be changed to achieve different reactions, changes to the speed and motion of the shot response are limited. Other resetting targets have a fixed pivot point and use counterweights to return the target to the upright position.

When hit, the lower portion of the target (below the pivot point) arches up and toward the shooter as the top portion moves downward and away from the shooter. This motion does not create a realistic visual shot response.

There are several portable targets that lay flat when hit and can be brought back into the upright position with electric, pneumatic, hydraulic, mechanical or manual reset power. All of these targets rely on the portable power source to raise the target into the upright position, or on manual urging, or some other mechanical device.

As such, they drain the power source with each reset of the target or require manual exertion. Most "automated" units require 3-8 seconds to reset into the upright position which is not ideal for fast target acquisition shooting. Because of the motors and mechanical mechanisms required to lift the target, these models are heavy and difficult for one person to carry into the field. They are also expensive to manufacture because of mechanics required to lift the target.

Some target designs provide random, subtle, lifelike movements. These designs use electric motors or pneumatics combined with computer logic and mechanical linkage to create movement. As such, these designs are expensive to manufacture and require routine maintenance.

SUMMARY OF THE INVENTION

Accordingly, it is one objective of the invention to provide a modular target system that can be set-up in different ways to provide multiple, unique target functions.

It is another objective of the invention to provide an improved self-resetting and remotely-controllable reactive target.

To this end, one preferred embodiment of the invention contemplates a lightweight, portable, target that can be configured for multiple training exercises and recreational uses. The target can be used with a wide range of ballistic projectiles, such as handgun ammunition and high velocity center fire rifle cartridges. It can also be used for paint ball, airsoft and archery shooting. The target plates and cardboard silhouettes may be interchangeable so different sizes and shapes can be mounted to the target post at different heights.

In one embodiment, the target apparatus includes a base having a flat surface and a rocker assembly. The rocker assembly includes a curved surface operatively disposed in rolling engagement with the flat surface, and a target support coupled thereto for supporting a target thereon. In an exemplary embodiment, the rocker assembly includes spaced apart rocker plates respectively defining the curved surface. The curved surface may be disposed in respective channels on or in the base. The base and/or optional channeled tracks are adjustable for inclination. The target support carries a target that may be attached to a post. Responsive to an impact from a ballistic projectile on the target, the rocker assembly rocks rearwardly, rocking the rocker on the base.

In some embodiments, the target may be held in lowered position by latch system, and upon release of the latch system, the target rotates upward as the rocker assembly rocks forward on the base. The latch system may be remotely controllable.

In another embodiment, the rocker assembly and the base are positioned at a right angle to the plane of the target allowing the target to rock from left to right i.e., side to side, when viewed by the shooter. The movement of the target may be remotely controlled such as through the action of a push solenoid or pneumatic piston. In other embodiments, the target may include a sail on a rearward surface of the target allowing random movement of the target affected by gusts of wind. The target may also swing into view from behind a barrier.

There are several distinctive ways in which the target apparatus described herein can be used based on various configurations of the basic elements of the invention. These include a knock down targets wherein the force of the projectile forces causes the target to fall back. The target resets itself due to the weight and the curved surface of the rocker assembly. The target may be held in the knocked down position by a latch system that can be release to allow the target to reset itself. The target can be a swinging target. The target may be set-up in a knocked down position and allowed to pop up on command or may be configured for random movement such as through the use of a sail. Each of these non-limiting exemplary potential uses of the target apparatus is discussed in below.

Many parts are common to various configurations. All configurations use the weight of the rocker assembly, which may be supplemented with counterweights, to return the target to the upright or vertical position; however, according to the invention, there is no fixed pivot point about which the rocker assembly rotates in any application. The bottom of the rocker assembly of the target apparatus has a curved shape and therefore only a small amount of force is required to "rock" the target.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1A:
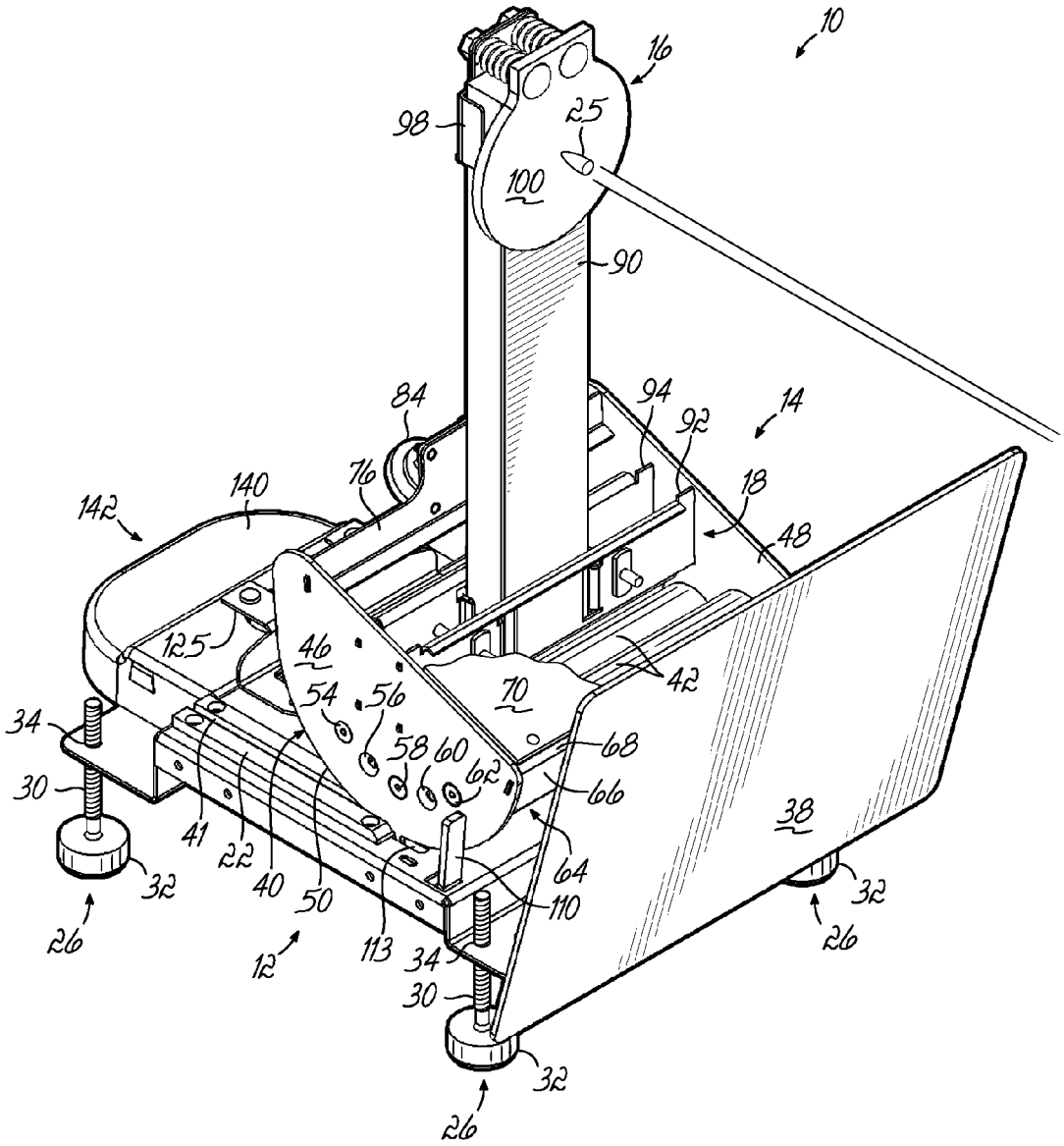
FIG. 1A is a perspective view that illustrating the self resetting target embodiment according to the invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiment illustrated.

As shown generally in FIGS. 1-11C, the target apparatus 10 of the present invention has a base 12 and a rocker assembly 14. The basic elements of the base 12 and the rocker assembly 14 allow a target 16 that is coupled to target support 18 to move between an upright position (see FIGS. 1A and 1C) and a horizontal position (FIG. 1B). These basic elements, which are described in greater detail, may be variously configured to allow the target apparatus 10 to be employed in various settings for multiple uses.

Figure 2:
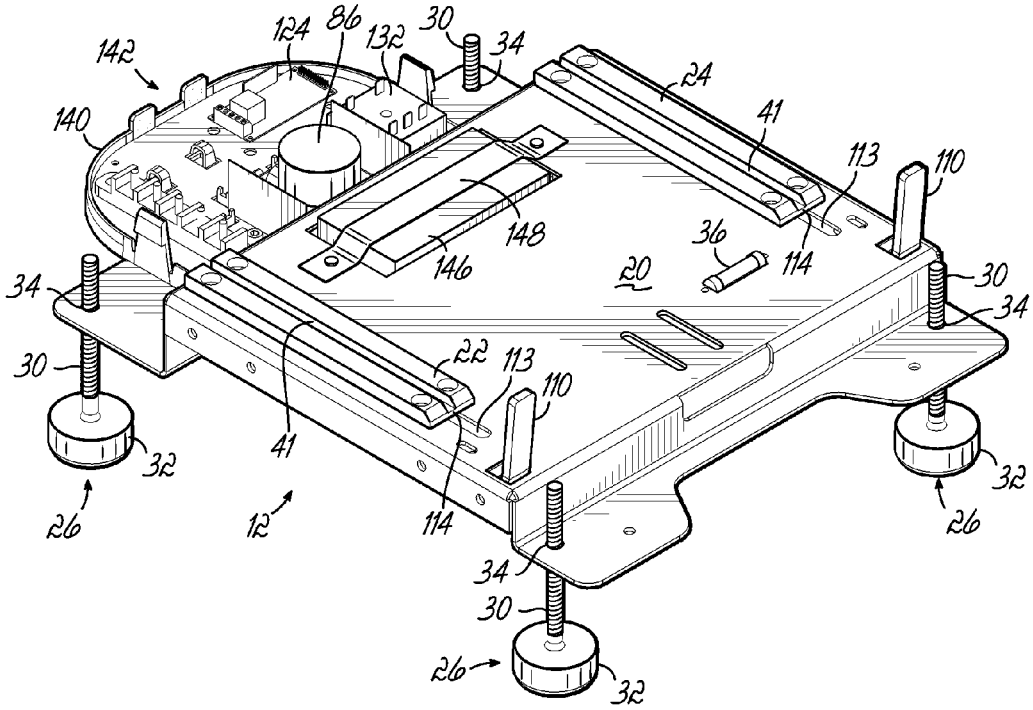
FIG. 2 is an isometric front quarter view of the base according to the invention.
Figure 4:
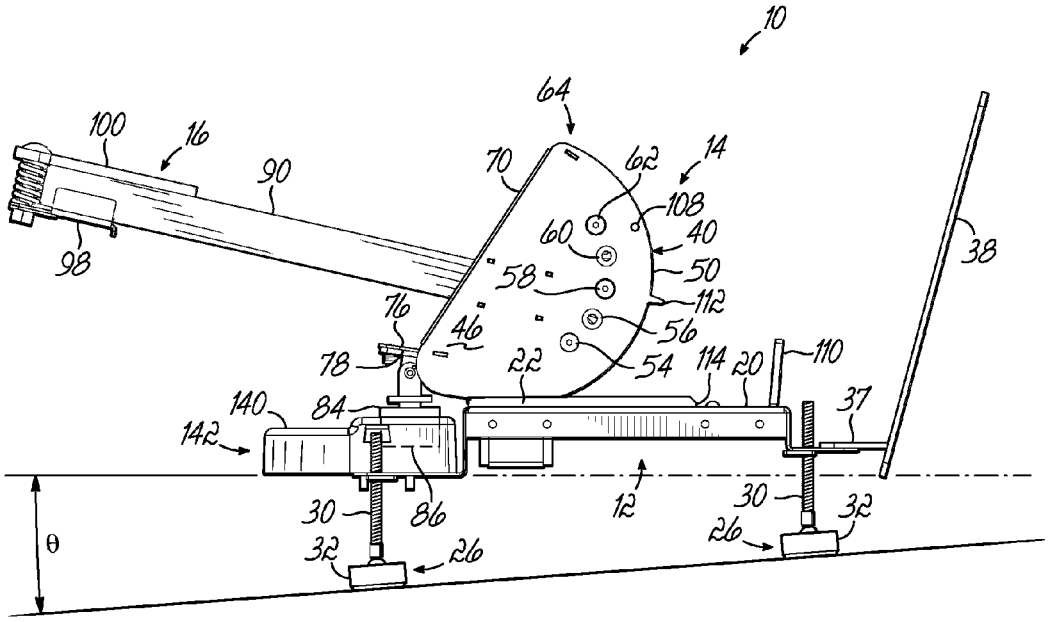
FIG. 4 is a side view illustrating the knock down target embodiment with the target in the lowered position according to the invention.
Figure 3:
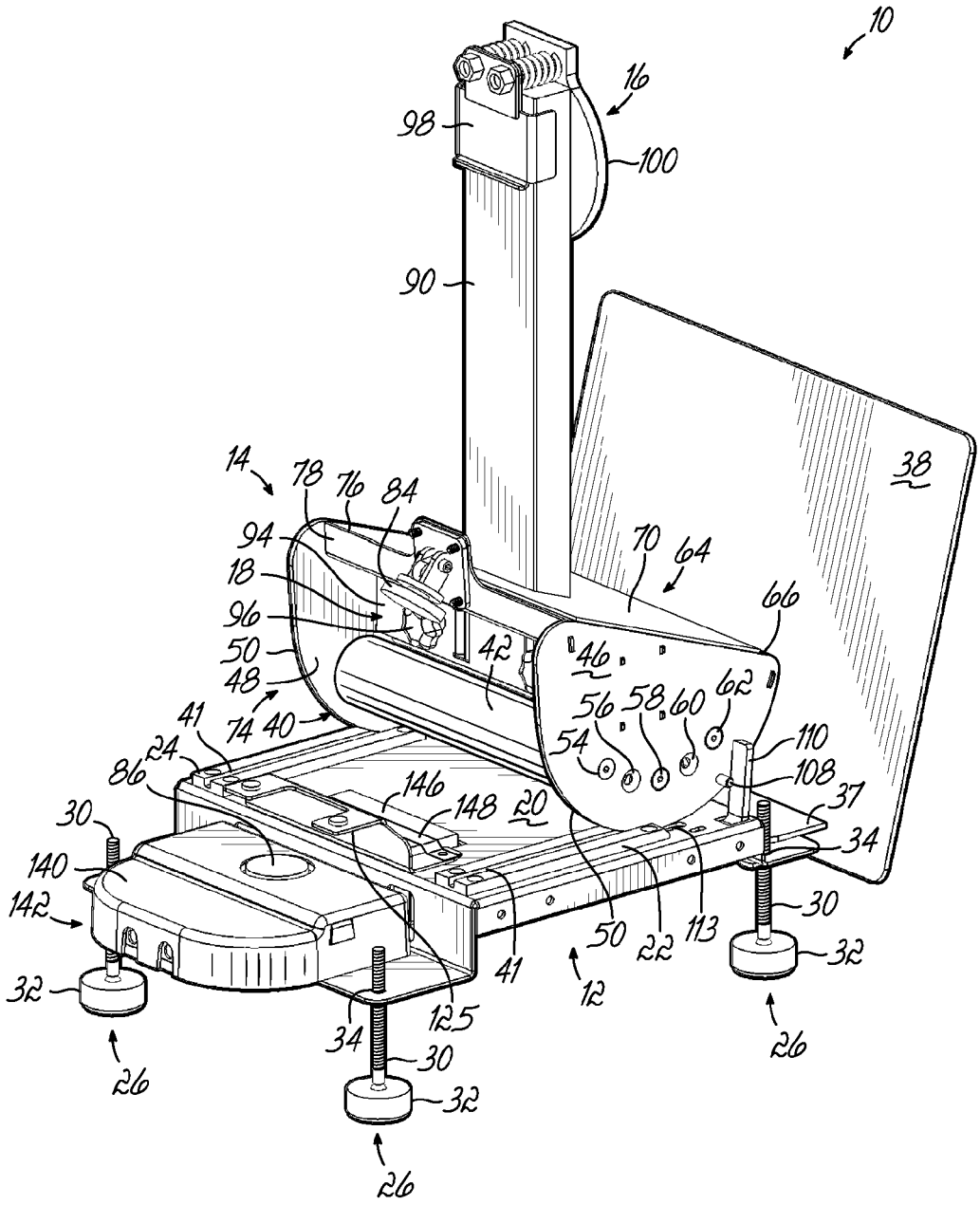
FIG. 3 is a back elevational view illustrating the knock down target embodiment according to the invention.
Figure 5:
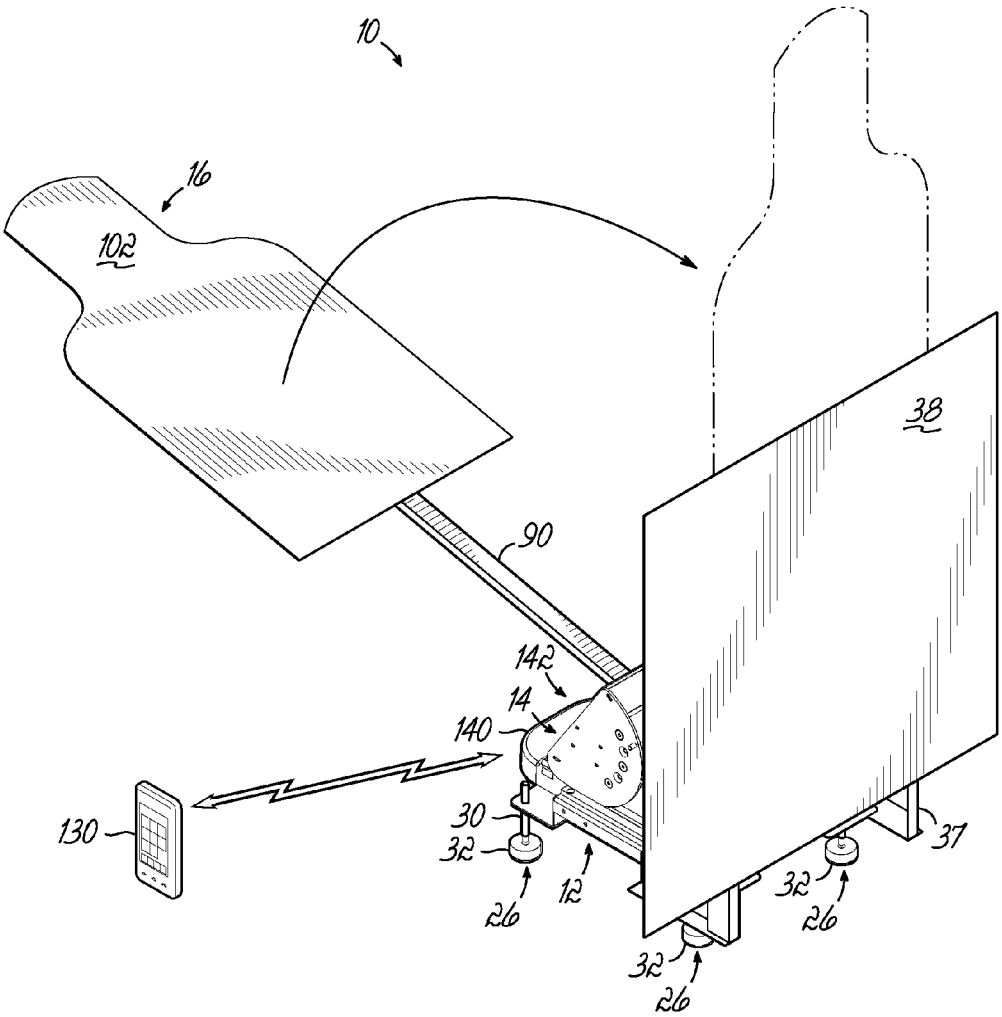
FIG. 5 perspective view of the pop-up target embodiment according to the invention with the target concealed.

The base 12, shown best in FIGS. 2-4, provides a flat surface for supporting the rocker assembly 14 (as shown in the remaining figures). The flat surface of the base 12 provides a low resistance path of travel for the rocker assembly 14. In the preferred embodiment, the base has at least one channel 41 in which the curved surface of the rocker assembly 14 travels. The preferred shape of the channel may be that of a flat bottom "v," however, other shapes for the channel 41 may be acceptable as well.

The at least one channel, 41, may be integrally formed with the base or separately formed in tracks 22, 24 and coupled to the base 12. In the exemplary embodiment shown herein, the base has two tracks 22, 24 with channels 41.

The at least one channel 41 are configured to guide the path of travel of the rocker assembly 14 and maintain the correct position of the rocker assembly 14 after a target 16 which is coupled to the rocker assembly 14 is contacted with a ballistic projectile 25 (shown in FIG. 1).

The base 12 may also include a structure for leveling the base 12 and adjusting the angle of inclination of the base 12 or tracks 22, 24. For example, in one embodiment, one or more leveling feet 26 may be employed for this purpose. The leveling feet 26 may include for example, a threaded shaft 30 having coupled to one end an adjustable foot 32. The base 12 may include a bore threaded 34 to accept the threaded shaft 32 of the leveling feet 26. The leveling feet 26 are adjusted by rotating the threaded shaft 30 thereby changing the distance between the base 12 and the adjustable foot 32. In a preferred embodiment, the base 12 includes four leveling feet 26 that may be individually adjusted to level or adjust the angle of inclination θ of the base 12. While the preferred embodiment has four adjustable feet 26, other mechanisms for leveling the base 12 and adjusting the angle of inclination θ of the base 12 or tracks 22, 24 are considered within the scope of the invention.

As mentioned above, the leveling feet 26 can be used to adjust the angle of inclination θ of the base 12 in the direction of movement of the rocker assembly 12 thereby also adjusting the angle of incline θ of the tracks 22, 24 disposed thereon. In addition, it is contemplated that the angle of incline θ of the tracks 22, 24 may be adjusted separately from adjustments made to the base 12. For this embodiment, the tracks 22, 24 will include an adjustment mechanism (not shown), such as a threaded shaft and bore configuration similar to that describe above for the leveling feet 26. Adjusting the inclination of the tracks 22, 24 changes the amount of force required to knock the target 16 and, correspondingly, the rocker assembly into the horizontal position, as shown in FIG. 1B. This allows the user of the target apparatus 10 to easily adjust the target apparatus 10 for use with different types of ballistic projectiles 25, such as projectiles from a small caliber handgun, which will exert less force on the target 16, or a high caliber rifle, which will exert a much larger force on the target 16. The angle of incline θ of the base 12 can also affect the speed and force with which the rocker assembly 14 returns to the upright position, as shown in FIG. 1C. The base 12 may include one or more spirit levels 36 to assist with leveling the base 12 and adjusting the angle of inclination θ of the base 12 4 during set-up. In addition, the curved surface 40 of the rocker assembly 14 allows for the angle of inclination θ of the base 12 to be increased without affected the presentation of the target to the shooter so that even when the angle of inclination is at its greatest, the target will still appear to be upright to the shooter as opposed to leaning toward the shooter.

The base may also include at least one barrier bracket 37 position to support a barrier 38 obstructing the shooter's view of the target 16. The barrier 38 may take the form of merely a visual obstruction or may be used to replicate a hostage situation wherein the target is shielded from the shooter by the barrier. The barrier 38 could also include a bullet proof shield protecting the base 12 and rocker assembly from projectile fragments.

The rocker assembly 14 has a curved or radius shaped surface 40 that is operatively disposed on the flat surface of the base 12. Preferably, the curved surface 40 is disposed in the channel 41 of the base 12. The rocker assembly 14 also includes a target support 18. The rocker assembly 14 may optionally include at least one counter weight 42 to supplement the weight of the rocker assembly. In one embodiment, the rocker assembly 14 includes two side plates 46 and 48 defining respective curved surfaces 50. The two side plates 46, 48 are spaced apart by a distance. In embodiments having the at least one counter weight 42, it may fit within the space between the two side plates 46, 48. The combination of the curve of the curved surface 40 and the weight of the rocker assembly 14 allows the rocker assembly 14 to "rock" back and forth on the base 12. The rocker assembly 14 does not require attachment to the base 12 to maintain its position on the flat surface of the base 12. The curved surface 40 is of a size sufficient to allow the target to reach a substantially horizontal position and return to an upright position. It will be appreciated that this curved surface can take on many configurations such as a circular curved surface, or elliptical, or multiple type of curvatures. In one embodiment, the curved surface 40 allows the rocker assembly 14 to have a range of motion of about 90° or more and preferably up to about 180°. In another embodiment, the curved surface 40 allows the rocker assembly 14 to have a range of motion of between about 90° and 180°, or between about 100° and 170°. Thus, in these embodiments, relative to the position of the target support, the curved surface 40 of the rocker assembly 14 may extend both toward the front 64 of the rocker assembly and toward the back 74 of the rocker assembly when the rocker assembly 14 is in the upright position. In an alternative embodiment to the two-side plate embodiment above, the curved surface may be formed from a curved plate, such as a section cut from a wide diameter piece of tubing or a barrel on its side. The rocker assembly could be cast, molded, or cut from appropriate materials and formed into the desired shape.

The optional counter weights 42 can be moved into various positions relative to the curved surface 40. For example, the counter weights 42 can be moved into multiple positions 54, 56, 58, 60, and 62 along the side plates 46, 48 to change the visual response of the target 16 after impact with a projectile. The counter weights 42 can also be exchanged with lighter or heavier counter weights to adjust the amount of force required to move the target 16 into the horizontal position, thereby allowing use of the target apparatus 10 with multiple types of projectiles having different weights and velocities. The counter weights 42 can include metal pieces, sand, concrete, gravel, dirt, water, battery or other component or material having a weight sufficient to function as a counterweight.

The front 64 of the rocker assembly 14 may have a front brace 66 that adds stability to the rocker assembly 14 and provides a first mounting surface 68 for a shield 70 that protects the base 12 and rocker assembly 14 from bullet fragments.

The back 74 of the rocker assembly 14 may have a rear brace 76 that also adds stability to the rocker assembly 14 and provides a second mounting surface 78 for a latch catch 82, such as a magnet strike 84 for an electro-magnet 86.

Figure 1B:
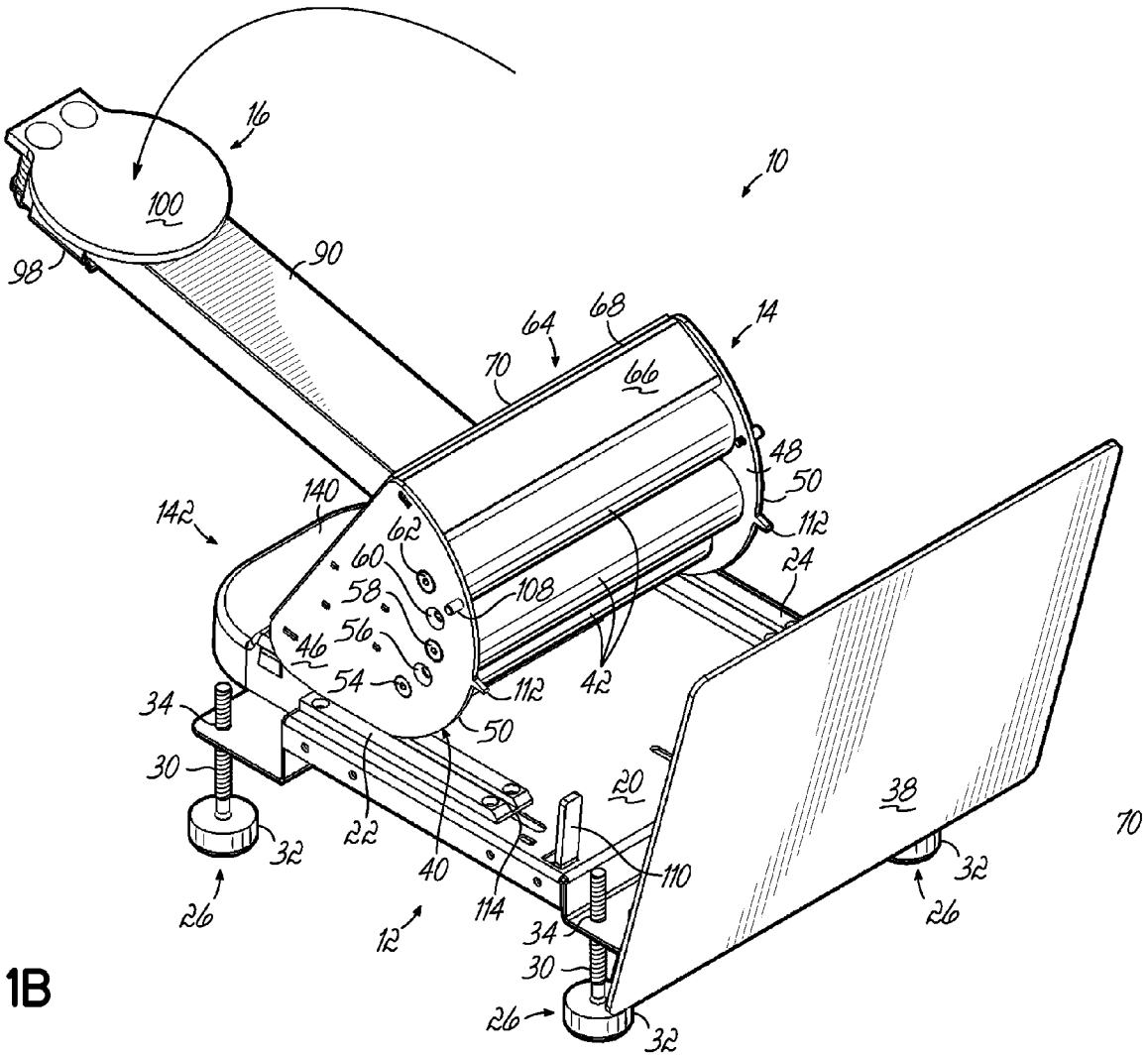
FIG. 1B is a perspective view that illustrating the self resetting target embodiment according to the invention with the target in the horizontal position.
Figure 1C:
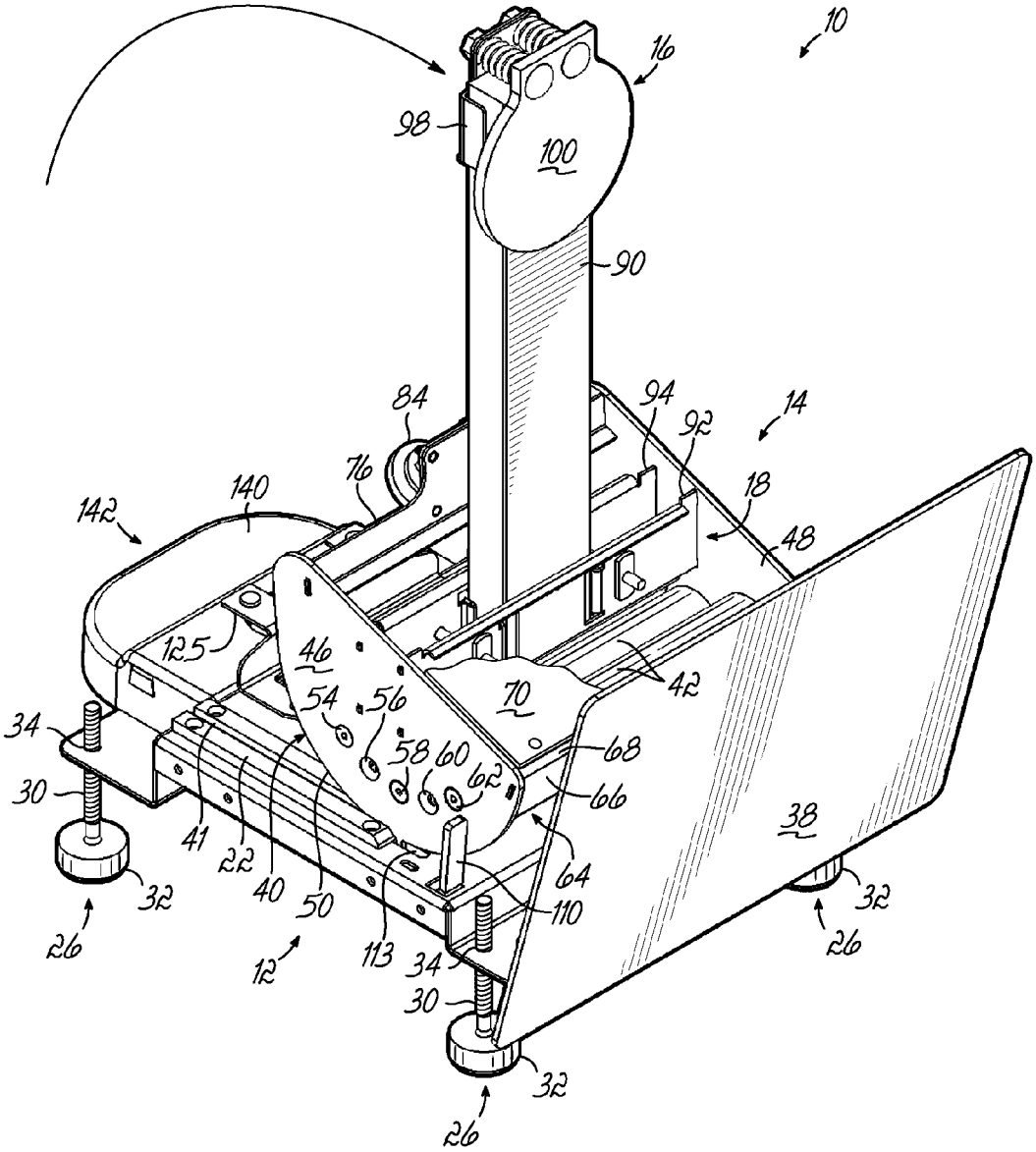
FIG. 1C is a perspective view that illustrating the self resetting target embodiment according to the invention with the target in the upright position.

As shown best in FIGS. 1A and 3, the rocker assembly 14 may also include a target support 18 that includes a target post coupling assembly for coupling a target post 90 to the rocker assembly 14. The target post coupling assembly may include a front and a rear post bracket 92 and 94, respectively, with at least one hand knob 96 designed to locate and clamp the target post 90 in position on the rocker assembly 14.

The target post 90 can be any material suitable for use with a target 16. For example, an exemplary target post 90 is a standard wood 2×4 that can be cut to various lengths. The target post 90 may be easily and inexpensively replaced by the user of the target apparatus 10. Another exemplary post (not shown) is made from molded polymer or a similar self-healing material. Another exemplary post (not shown) is formed of a hardened metal such as steal. As seen in FIGS. 3 and 4, a mounting bracket 98 may be used to secure the target plate 100 to the post. The mounting bracket may be welded or otherwise coupled to the back side of the target plate. In one embodiment, a target and post are formed from a unitary piece of material (not shown), such as a hardened steel. In such an embodiment, a mounting bracket 98 is not needed. A shim such as a rubber, metal, wood, or plastic shim may be used to fill the void between the post 90 and the front and rear post brackets 92, 94.

In some embodiments, the target 16 is a hardened target plate 100 that is made of a material hard enough to transfer the ballistic force of the projectile to the rocker assembly 14. Target plate 100 may be made from various materials, such as hardened steel, in varied thicknesses and hardness, depending on the mass and velocity of the projectiles that will be used. They can also be cut in various shapes and sizes. In other embodiments, do not utilize hardened target plates 100 but instead the target 16 is a pass through target 102 (FIG. 5) that is made of a material that allows the projectile to pass through the target 16 without transferring a significant amount of ballistic force to the rocker assembly 14. Pass through target 102 may be made of various materials that include paper, cardboard, plastic, cloth, and thin wood.

In some embodiments, the base 12 and rocker assembly 14 may be configured such that the target 16 is movable in a direction away from or toward a position in front of the target apparatus 10. The front of the target apparatus 10 is understood to be the side of the target apparatus 10 facing the shooter. In this configuration, shown in FIGS. 1A to 6, the target 16 appears to pop-up in front of the shooter and the ballistic force of the projectile may cause the target to rotate straight back into a horizontal position. As used herein, the term horizontal is not intended to require that the target reach an absolute horizontal position, but rather, the target reaches a lower or laid back position. Thus, horizontal position, is understood to include a substantially horizontal position.

In other embodiments, the base 12 and the rocker assembly 14 may be configured such that the target 16 is movable in a direction from side to side with respect to a position in front of the target apparatus 10. The front of the target apparatus 10 is understood to be the side of the target apparatus 10 facing the shooter. For this embodiment, the rocker assembly 14 is aligned in a direction that is perpendicular to a direction that runs from the back of the target apparatus to the front of the target apparatus. In this embodiment, shown in FIGS. 6-11C, the target 16 appears to swing from side to side. Specific aspects of these different embodiments are discussed in greater detail below.

As shown best in FIGS. 3 and 4, the base 12 and rocker assembly 14 may also include a braking assembly that includes two brake pins 108 and a corresponding brake tab 110. The brake pins 108 are associated with the sides of the rocker assembly 14 and the brake tabs 110 are associated with the base 12 at a brake position. The braking assembly may also include retention nubs 112 associated with the rocker assembly 14. The retention nubs 112 may be removable so the rocker assembly 14 can be universal to other applications. When the target 16 is in the upright position, the brake pins 108 are in contact with the brake tabs 110 and the retention nubs 112 contact the flat surface of the base 12, such as by resting against a front edge portion 114 of the tracks 22, 24 and/or by extending into an indentation or hole 113 in the base.

The braking assembly serves several purposes. The braking assembly prevents the rocker assembly 14 from twisting on the base 12 if a projectile hits the target plate 100 off center. This assures the rocker assembly 14 always begins in a straight backward motion. The braking assembly also assures the target 16 is reset into the original position and brings the target 16 to a prompt stop while limiting the "bounce" caused from the abrupt impact of the target 16 when reaching the upright position. To this end, the brake tabs 110 can be adjusted forward or backward on the base 12 to change the angle at which the target 16 is presented to the shooter. This adjustment can also be used to increase or decrease the force required to knock the target 16 into the horizontal position.

The target apparatus 10 may also include a latch system that controls the movement of the target 16 into the upright or reactive position. The latch system may include a latch associated with the base 12 and a latch catch associated with the rocker assembly 14. As shown in FIGS. 1A-5, an exemplary latch system may include an electro-magnet system wherein a battery powered electro-magnet 86 coupled to the base 12 engages a magnet strike 84 coupled to the rocking assembly 14 when the target 16 is in the horizontal position. The electro-magnet 86 functions as a latch and the magnet strike 84 functions as a latch catch. In the alternative, the latch could be associated with the rocker assembly 12 and the latch catch associated with the base. An electro-magnet system is shown by way of example and is no way intended to be limiting. Any suitable selective latching mechanism can be used as will be appreciated. While electro-mechanical devices are disclosed herein, also contemplated within the scope of the invention are pneumatic and hydraulic systems or purely mechanical latching as will be appreciated.

Other exemplary latch systems include mechanical latches coupled to an electronic control device such as a motor, servo, or electro-magnet which are electrically coupled to a circuit 124. Exemplary mechanical latches include latching mechanisms as known to those skilled in the art such as spring pins and clamps that are configured to retain the target 16 in the horizontal position. Any suitable selective latching mechanism can be used as will be appreciated. While electro-mechanical devices are disclosed herein, also contemplated within the scope of the invention are pneumatic and hydraulic systems or purely mechanical latching as will be appreciated.

When the target 16 is put into the horizontal position, such as by the force of a projectile or manually by the user, the target 16 is held in the horizontal or reacted position by the latch system. In some embodiments, a trigger may cause the latch system to release the target 16 from the horizontal or reacted position thereby allowing the counterweight 42 to roll the target 16 into the upright or reactive position. The target is reset into the upright position in about 0.5 to about 2.5 seconds. In addition, when in the horizontal or reacted position, the entire target apparatus 10 has a very low profile and can therefore be easily concealed behind a bank, log, or other natural or artificial barrier. A back stop bracket 125 may be used to stop the rocker assembly 14 when it reaches the horizontal position. The back stop bracket 125 may be used in conjunction with a latch system or independently thereof.

Figure 6:
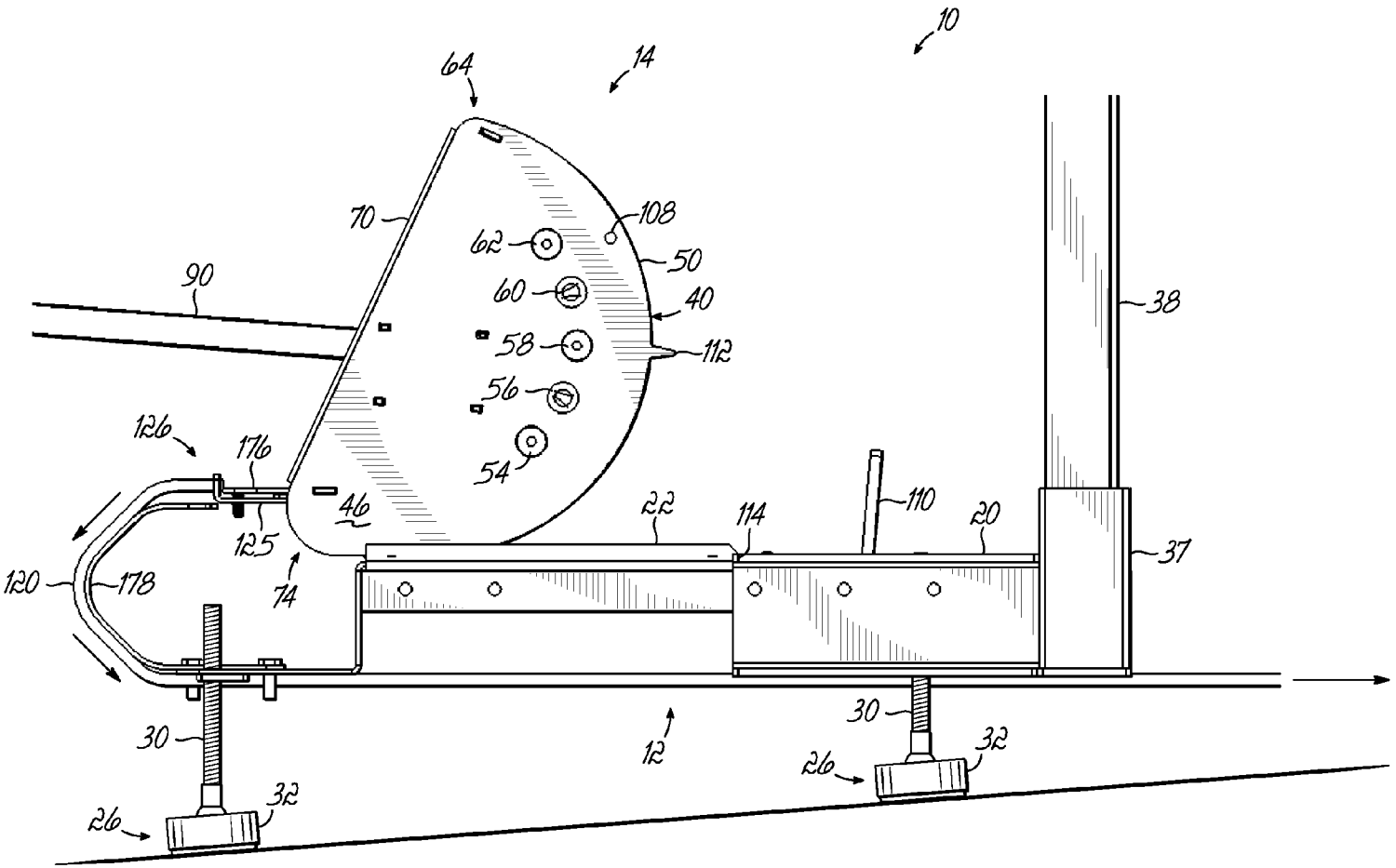
FIG. 6 is a side view of the pop-up target embodiment according to the invention showing the rope clamp clip.

The trigger that releases the target from the horizontal position may be mechanical and act directly on the latch system, or electrical and act through the electric circuit 124. An exemplary mechanical trigger includes a rope 120 attached to a rope clip bracket 126 such as shown in FIG. 6, that when pulled releases the target 16 into the upright or reactive position. Other mechanically triggered latching systems as known in the art may be used as well. An exemplary electronic trigger is a signal from a remote transmitter 130 that is received by a receiver 132 and electrically coupled to the latch system by the electric circuit 124 to cause the latch system to release the target into the upright or reactive position. Any suitable electric circuit and receiver can be used, therefore a diagram of the specific circuit is not shown. The remote transmitter 130 may communicate with the receiver 132 wirelessly or it may be hard wired. The remote transmitter 130 can be manually operated by the user or function as a computer or programmable module to transmit a random or pre-programmed routine. Additional exemplary sources for an electronic trigger include a timer (not shown) or a motion detector (not shown) that are electrically coupled to the latch system by the electric circuit 124 and can cause the latch system to release the target 16 into the upright position. At least some of the electrical components, such as the electric circuit 124 and the electro-magnet 86, receiver 132, timer, and motion detector, may be enclosed in an electronic sub-assembly 140 which may be mounted on the back end 142 of the base 12. Other electronic triggers as known in the art may be used as well. The electronic circuit 124 will also include a power supply, such as an battery 146 or a solar panel. Other sources of power, such as a generator or power from an electrical outlet, may also serve as a power supply. The power source for some embodiments can include a pneumatic power supply that is used in conjunction with a latch system to hold and release the target 16. In embodiments that include a battery 146, a battery strap 148 may be used to support the battery 146 within the base 12.

An exemplary latch system may include an electro-magnet system wherein a battery powered electro-magnet 86 coupled to the base 12 engages a magnet strike 84 coupled to the rocking assembly 14 when the target 16 is in the horizontal position. The electro-magnet 86 functions as a latch and the magnet strike 84 functions as a latch catch 82. Other exemplary latch systems include mechanical latches coupled to an electronic control device such as a motor, servo, or electro-magnet which are electrically coupled to the circuit 124. Exemplary mechanical latches include latching mechanisms as known to those skilled in the art such as spring pins and clamps that are configured to retain the target 16 in the horizontal position. Any suitable selective latching mechanism can be used as will be appreciated. While electro-mechanical devices are disclosed herein, also contemplated within the scope of the invention are pneumatic and hydraulic systems or purely mechanical latching as will be appreciated.

An exemplary remotely controlled target apparatus includes a battery powered electro-magnet 86 associated with one of the base 12 or rocker assembly 14 that engages a magnet strike 84 associated with the other of the base 12 or the rocking assembly 14 when the target 16 reaches the horizontal position. The user activates a remote transmitter 130 to send a signal to a receiver 132 electrically coupled to the circuit 124. When the circuit 124 is opened in response to a signal from the remote transmitter 130 that is received by the receiver 132, the electro-magnet 86 loses power and releases the target 16 to return to the upright position. Multiple target apparatuses 10 can be programmed to receive signals from a common remote transmitter 130. Targets 16 can be released to rise in random sequences with the remote transmitter 130 which creates a challenge for the shooter to quickly acquire and engage the activated targets 16.

Some embodiments having electrically controlled latch system may include an optional momentary switch assembly that includes a momentary push button switch (normally closed) to conserve power. The momentary push button switch and associated bracket are not shown, however, they would be positioned similarly to solenoid 164, shown in FIG.

7. In this configuration, the momentary switch is mounted to the front of the base. When the target comes to rest in the upright position, the front brace 66 depresses the momentary push button switch disabling the power to the electrically controlled latch system, such as an electro-magnet 86. When the target plate 100 is hit with a projectile, the rocker assembly 14 rocks backward thus releasing the momentary push button switch and re-applying electricity to the latching system, e.g., an electro-magnet 86. In this configuration, power is only being consumed while the target is being held down in the horizontal position.

In some embodiments the push button switch assembly may be used in an optional simulated return fire assembly that includes uses a momentary push button switch (except in this instance the switch is normally open), switch mounting bracket, delay timer (not shown), and LED flashers 167 to simulate return fire. In this configuration, the push button switch assembly is mounted to the front of the base. The delay timer is installed in the electronic sub-assembly. The LED flashers are mounted so that they are visible to the shooter and are electrically coupled via a circuit to the momentary switch, delay timer, and power source. When the target is being held in the horizontal concealed position, the momentary switch is not depressed (circuit open) and the LED flashers remain off. When the target is activated, such as with a remote transmitter, the latching system releases the target. The counterweights return the target 16 to the upright position and the front brace 66 of the rocker assembly 14 depresses the momentary switch. This closes the circuit and sends power to the delay timer. After the designated (adjustable) time delay, power is passed through to the LED flashers simulating return fire. This exercise would induce stress and require shooters to acquire and engage the target within a specified time period to prevent being simulated return fire from the target.

Some embodiments may include an optional spring-loaded plunger (not shown) that is depressed when the target 16 moves into the horizontal position. The spring loaded plunger may assist the movement of the target 16 toward the upright position and may also help to overcome any remaining magnetic field in the electro-magnet 86 once power to the magnet is discontinued.

Figure 7:
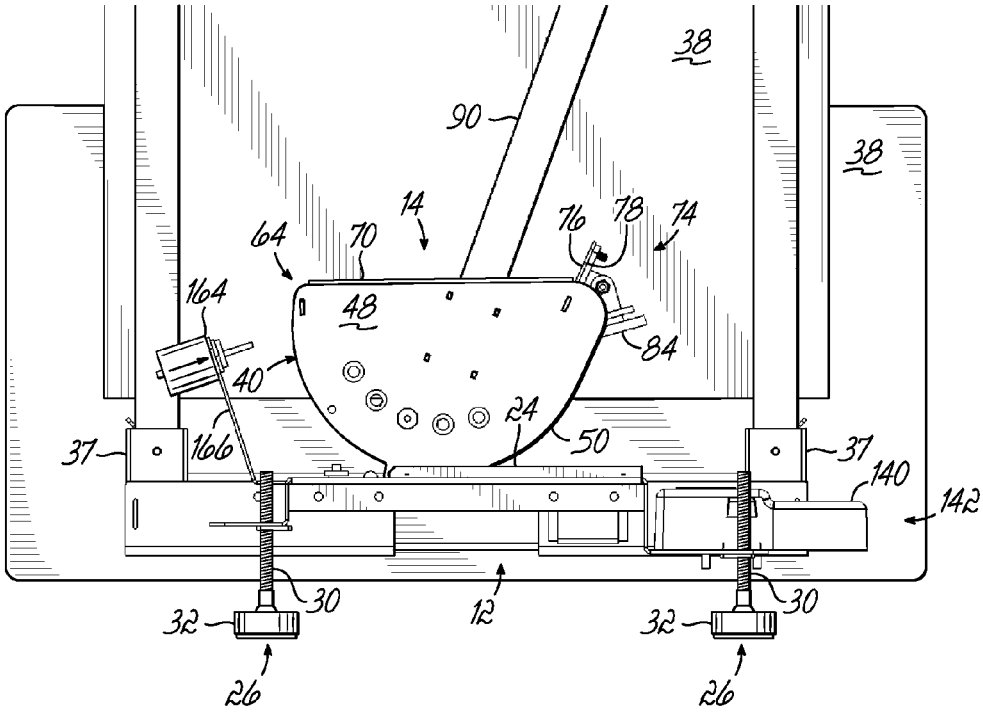
FIG. 7 is a back view of the remotely exposed target embodiment according to the invention.
Figure 9:
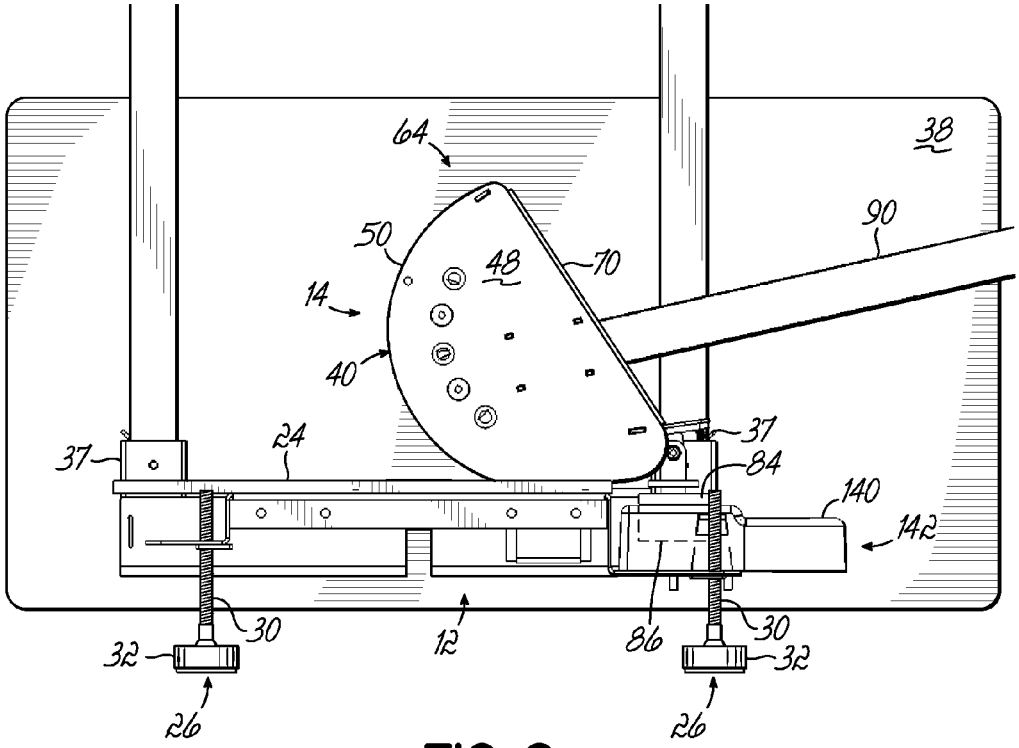
FIG. 9 is a back view of the swinging target embodiment according to the invention.
Figure 8B:
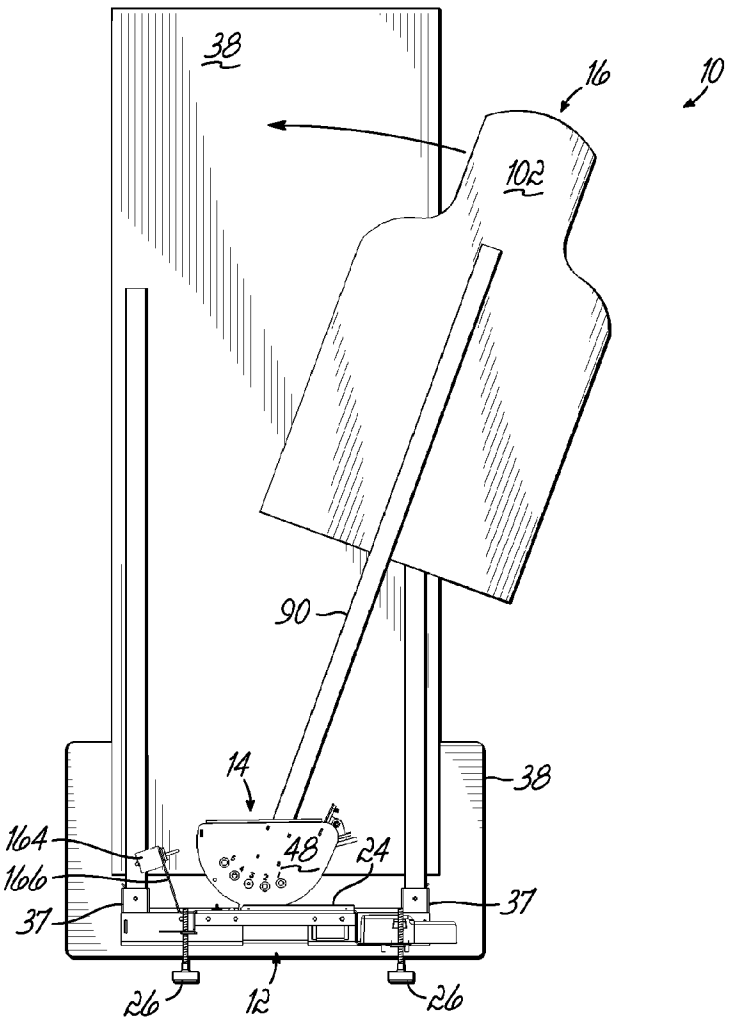
FIG. 8B is a back view of the remotely exposed target embodiment according to the invention.

It may be desirable for the user of the target apparatus 10 to have some control over the movement of the target 16. Therefore, some embodiments, as shown in FIGS. 7 and 8B, include a push solenoid 164 mounted on solenoid bracket 166 which is mounted to the base 12. When actuated, the push solenoid 164 applies a force to the rocker assembly 14 causing a side to side movement of the target 16. The push solenoid 164 may be wired to a trigger such as a receiver 132 for a remote transmitter 130, and a power source 146 using an electric circuit 124.

Figure 11C:
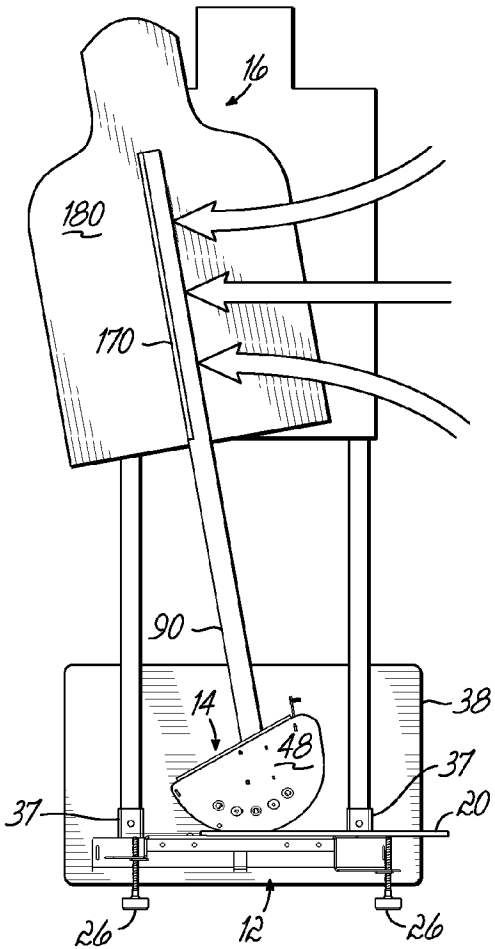
FIG. 11C is a back view of the random moving target embodiment according to the invention showing the sail.
Figure 11B:
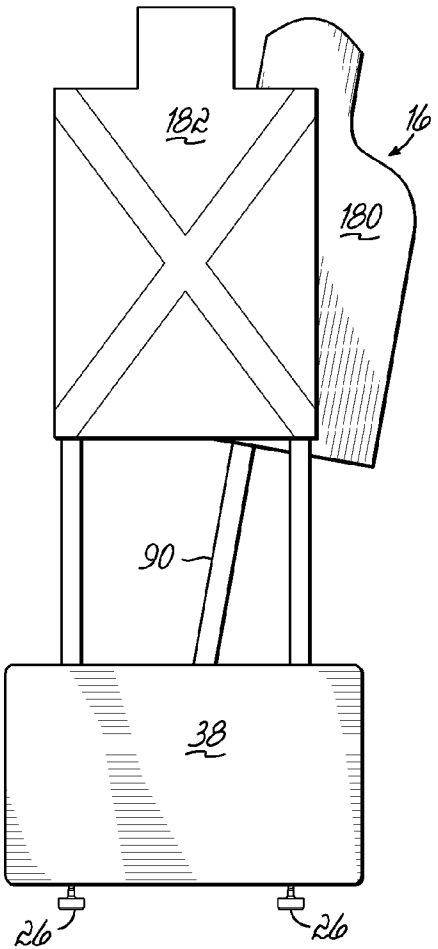
FIG. 11B is a front view of the random moving target embodiment according to the invention with the threat revealed.
Figure 11A:
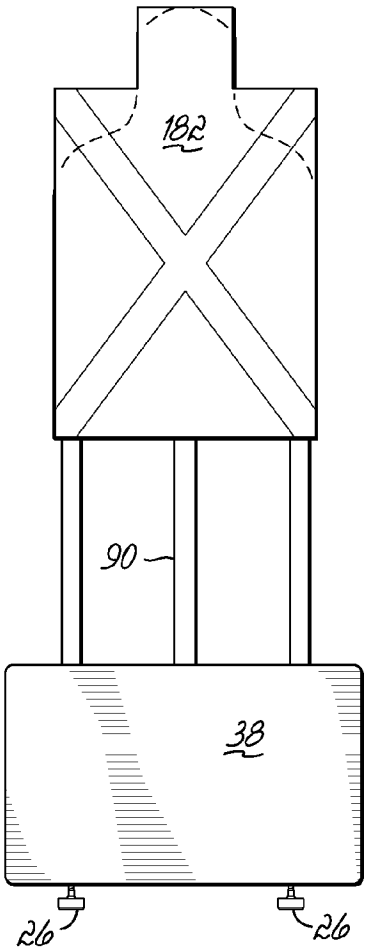
FIG. 11A is a front view of the random moving target embodiment according to the invention with the threat concealed.

It may be also desirable for the target 16 to display random movements, such as with embodiments where the base 12 and the rocker assembly 14 are configured such that the target 16 is movable in a direction from side to side with respect to a position in front of the target 16. Therefore, some embodiments include a sail 170 is coupled to at least one of the target post 90, the target support 18, the target 16, and the rocker assembly 14 to impart random movement to the target. In an exemplary embodiment, the sail 170 is a strip of material attached to the back of the target post 90, perpendicular to and concealed behind the target 16, as shown in FIG. 11C. The sail 170 can be made from any suitable material, such as cardboard, heavy paper, plastic, rubber, metal, wood, etc. In this configuration, gusts of wind will cause random movements of the target. While the exemplary sail illustrated herein is shown as a strip of material attached to the backside of the target post, the term sail is understood to include other structures that can catch the wind to impart random movement of the target.

Described below are several embodiments that use various combinations of the components described above. These embodiments illustrate how the components described above can be combined to produce target apparatuses useful for multiple types of training.

Self Resetting Target Embodiment—

For this embodiment, the base 12 and rocker assembly 14 are configured such that the target 16 is movable in a direction away from or toward a position in front of the target. When a projectile strikes the target plate 100, the rocker assembly 14 rolls backward (away from the shooter) bringing the target 16 into the horizontal or reacted position. This motion creates a smooth, dramatic, visual shot response. This embodiment is self resetting because the target 16 is automatically returns to the upright or reactive position after being hit with a projectile due to the curved surface 40 and counter weights 42 of the rocker assembly 14. This embodiment may include various features described above including the brake assembly 102. The self-resetting target configuration is best exemplified in FIGS. 1A-1C.

Knock Down Target Embodiment—

For this embodiment, the base 12 and rocker assembly 14 are configured such that the target 16 is movable in a direction away from or toward a position in front of the target. When a projectile strikes the target plate 100, the rocker assembly 14 rolls backward (away from the shooter) bringing the target 16 into the horizontal or reacted position. Once in the horizontal position, the target 16 is held in the horizontal or reacted position by the latch system, such as an electro-magnet 86 and magnet strike 84 as described above. A trigger, such as a signal from a remote transmitter that is received by a trigger, causes the latch system to release the target 16 from the horizontal or reacted position thereby allowing the counterweight 42 to roll the target 16 into the upright or reactive position. This embodiment may include various features described above including the brake assembly. This embodiment is best exemplified in FIGS. 3 and 4.

Pop Up Target Embodiment—

For this embodiment, the base 12 and rocker assembly 14 are configured such that the target 16 is movable in a direction away from or toward a position in front of the target. This embodiment does not use a target plate 100. Instead, a pass through target 102, such as a silhouette made of cardboard or paper is used as the target 16. The target 16 starts in the horizontal position (reacted) position and is held in place by a latch system, such as an electro-magnet 86 or rope clip 126. Barrier brackets 37 can be used to support a visual barrier 38 which conceals the target 16 when it is in the horizontal position.

When an electronically controlled latch system is used, such as an electro-magnet, a trigger, such as a receiver, is electrically coupled to the latch system via a circuit 124. When trigger is activated, such as by a signal sent from a remote transmitter to the receiver, the circuit is opened and the magnet releases the target to return to the upright (reactive) position. The target swings upright toward to the shooter thereby quickly presenting itself to the shooter. This embodiment is best exemplified in FIG. 5.

When an electronic latch system is not used, a mechanical latch system, such as a rope clip bracket 126 and rope 120, may be used to operate the latch system. For the rope clip bracket 126, the rope clip 176 is wedged between the rear brace 76 and the back stop bracket 125 to maintain the target 16 in the horizontal position. A rope guide bracket 178 is used to direct the motion of the rope 120 straight rearward when it is pulled from the front of the target 16. When the rope 120 is pulled, the rope clip 176 is disengaged and the rocker assembly 14 is released allowing the target 16 to quickly rocks forward to return to the upright (reactive) position. This embodiment is best exemplified in FIG. 6. Other types of mechanical and electronic latches are considered within the scope of this invention.

When the rocker assembly 14 resets to the upright position, the brake pins 108 contact the brake tabs 110 and the retention nubs 112 slide backward until they contact the front edge 114 of the tracks 22, 24 or rear edge of the hole 113. These features bring the target 16 to a prompt stop while limiting the "bounce" caused from the abrupt impact.

Remotely exposed target embodiment. For this embodiment, the base 12 and rocker assembly 14 are configured such that the target 16 is movable in a direction from side to side with respect to a position in front of the target 16. This embodiment does not use a target plate 100. Instead, a pass through target 102, such as a silhouette made of cardboard or paper is used as the target 16.

The counterweights 42 are adjustable to minimize the force required to set the target 16 into motion. A set of barrier brackets 37 are used to support a visual barrier 38. The visual barrier 38 conceals the target 16 when it's in the neutral position. A push solenoid 164 is mounted to solenoid bracket 166 and a receiver 132 is wired to the solenoid 164 and a power source such as a battery 146.

Figure 8A:
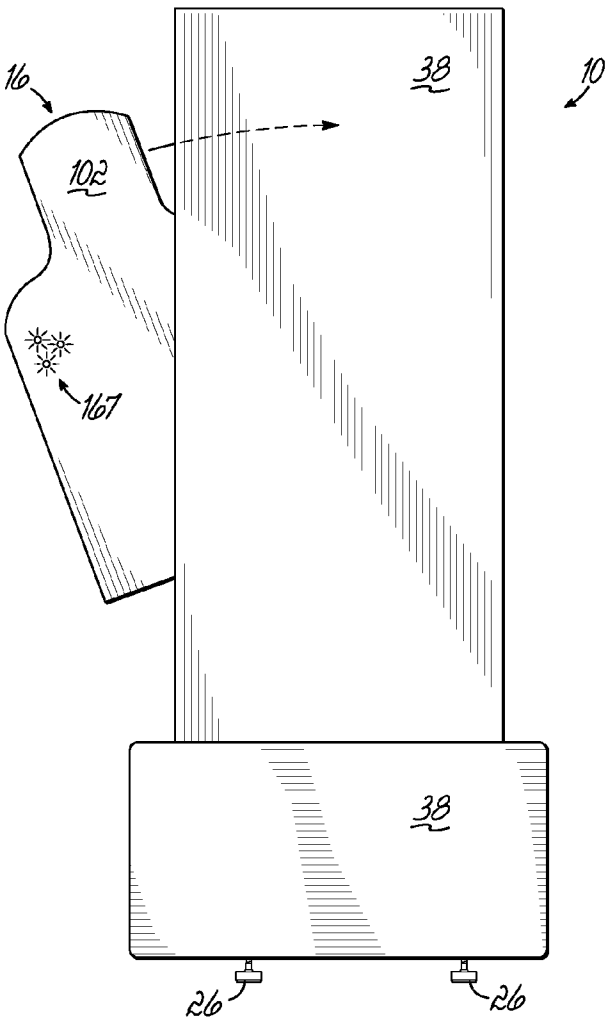
FIG. 8A is a front view of the remotely exposed target embodiment according to the invention.
Figure 10:
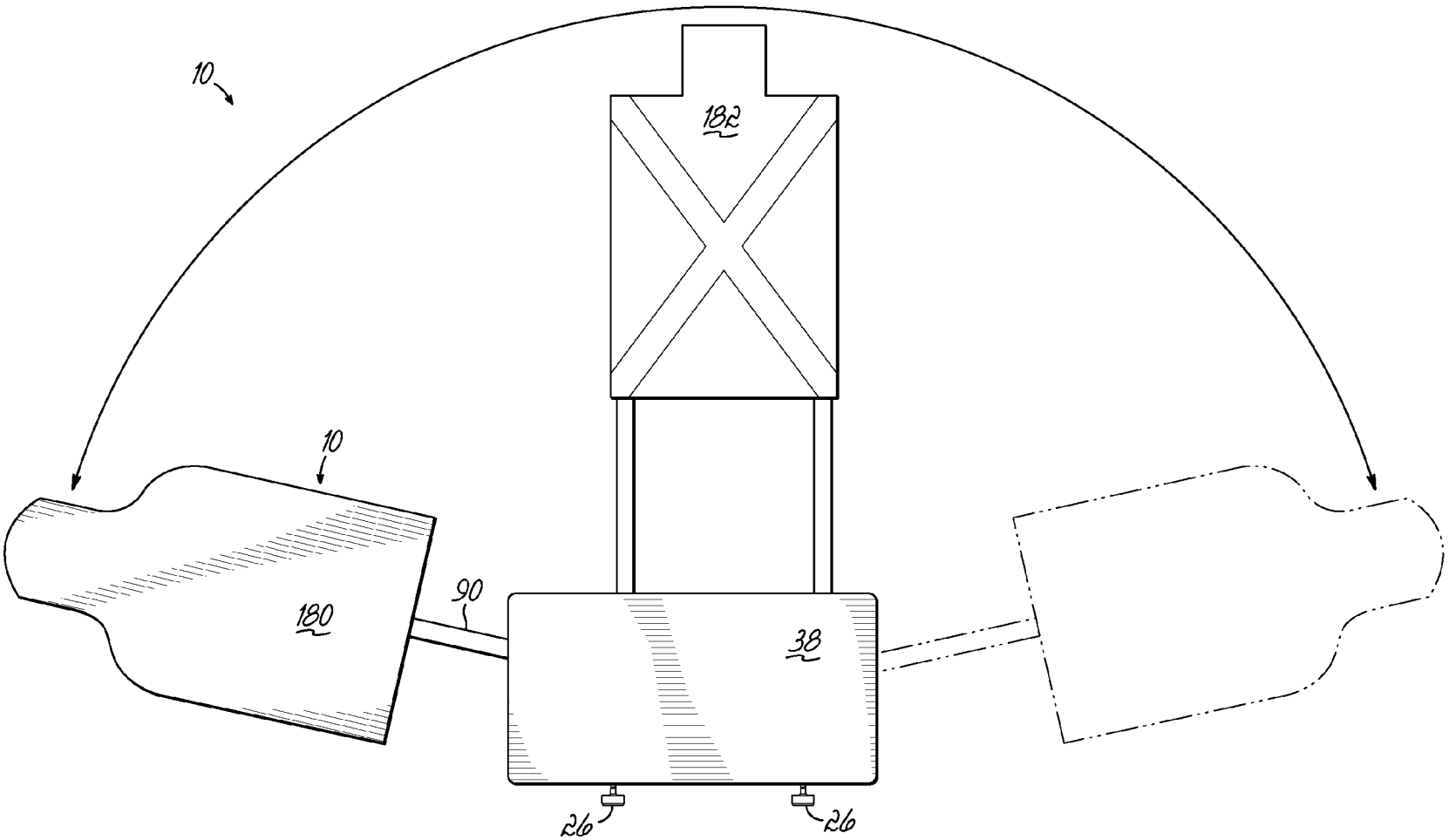
FIG. 10 is a front view of the swinging target embodiment according to the invention.

When a remote transmitter 130 sends a signal to the receiver 132, the circuit is closed and the solenoid 164 momentarily pushes the rocker assembly 14 and target 16 into motion. The target 16 rocks out from behind the barrier 38 exposing itself to the shooter. The counter weights 42 then roll the target 16 back into the neutral upright position behind the barrier 38. This embodiment is best shown in FIGS. 7 to 8B. Multiple targets can be programmed to receive signals from a common transmitter. The multiple targets can be oriented behind one barrier or multiple barriers.

When multiple targets are used, one can be set-up with a "threat" target 180; the other can be set-up with a "non-threat" target 182. The remote transmitter can be used to present the targets to the shooter in random sequences creating a realistic decision making experience.

Swinging Target—

For this embodiment, the base 12 and rocker assembly 14 are configured such that the target 16 is movable in a direction from side to side with respect to a position in front of the target 16. This embodiment does not use a target plate 100. Instead, a pass through target 102, such as a silhouette made of cardboard or paper is used as the target 16.

The counter weights 42 are adjustable to achieve the desired speed of the rocking motion. This configuration uses extended tracks 22, 24 and a rocker assembly 14 with no retention nubs 112. The brake tabs 110 also are not necessary. Barrier brackets 37 can be used to support a "no-threat" target. The target 16 starts in the horizontal position and is held in place by a latch system, such as an electro-magnet 86 or a rope clip 126.

When an electronically controlled latch system is used, such as an electro-magnet, a trigger, such as a receiver, is electrically coupled to the latch system via a circuit 124. When the trigger is activated, such as by a signal sent from a remote transmitter 130 to the receiver, the circuit is opened and the latch 12, e.g., electro-magnet 86, releases the target 16 sending it into a left and right swinging motion. The target 16 rocks back and forth creating a moving target for the shooter to engage. This embodiment is best exemplified in FIGS. 9 and 10.

When an electronic latch system is not used, a mechanical latch system, such as a rope clip bracket 126 and rope 120, may be used to operate the latch system. For the rope clip bracket 126, the rope clip 176 is wedged between the rear brace 76 and the back stop bracket 125 to maintain the target 16 in the horizontal position. A rope guide bracket 178 is used to direct the motion of the rope 120 straight rearward when it is pulled from the front of the target 16. When the rope 120 is pulled, the rope clip 174 is disengaged and the rocker assembly 14 is released allowing the target 16 to start moving into a swinging motion. The rope clamp is best exemplified in FIG. 6.

Random Movement Target Embodiment—

For this embodiment, the base 12 and rocker assembly 14 are configured such that the target 16 is movable in a direction from side to side with respect to a position in front of the target 16. This embodiment does not use a target plate 100. Instead, a pass through target 102, such as a silhouette made of cardboard or paper is used as the target 16. In addition, a sail 170 is attached to the target post 90 so that it is perpendicular to and concealed behind the target 16. The sail 170 can be made from any suitable material, such as cardboard, heavy paper, plastic, rubber, metal, wood, etc.

This embodiment does not require that the rocker assembly 14 include the components of the brake assembly. Barrier brackets 37 may be used to support a "non-threat" target. The counter weights and the size of the sail can be adjusted to achieve the desired wind resistance and target movement. This embodiment is best exemplified in FIGS. 11A-11C.

In this configuration, wind creates random subtle movement of the "threat" target behind a stationary "non-threat" target.

In an alternate embodiment, two or more target apparatuses 10 may be placed in line with each other (without the Barrier Brackets and stationary target) such that both silhouettes move randomly side to side from the shooters perspective. Each target assembly may be set-up with different counterweights and sail sizes so they react differently and unexpectedly depending on the speed and direction of the wind gusts.

The target apparatuses described herein have several advantages over the prior art. While some of these advantages are discussed below, they are not intended to limit the scope of the claimed invention.

One advantage of many of the embodiments of the target apparatus 10 described herein are that they require no mechanical devices or external power sources to raise the target, therefore the manufacturing costs are reduced and the target apparatus 10 is not restricted to a specific number of cycles between power supply charges. For the target apparatuses 10 that utilize electricity for the electric circuit 124 and/or to power an electro-magnet, energy consumption is very low allowing for greater number of cycles between battery charges. No other known target system uses the combination of a radius-shaped rocker, counterweights, and flat base with an adjustable incline to create a target that "rocks" down to a "reacted" position and back up to a "reactive" position under its own power.

Moreover, no other known target system uses an electromagnet or electronic latch mechanism to hold the target down so it can be released by remote control and lifted upward under its own power.

The rocking assembly with the curved surface 40 and optional counterweight 42 provides a more realistic, more dramatic shot response than spring reset targets and counterweight targets with fixed pivot points.

The target apparatus 10 can be set up in different configurations for at least six unique shooting experiences: self resetting target, knock down target, pop-up target, remote exposed target, swinging target, random moving target. And, the target is significantly less expensive to produce and use than other resetting targets that use a power source and mechanical mechanism to lift the target into the reset position.

Unlike all other remote controlled targets, no power is consumed with each target reset. Also, unique is that this design allows the target to reset quickly (about 0.5 to about 2.5 seconds) which creates a more challenging shooting experience. To this end, the target can be easily adjusted to provide the desired visual shot response with a wide range of ammunition.

This target is portable and lighter weight (45 lbs) compared to most other remote controlled resetting targets. This target has a compact design that fits within an 18"×15"×4" package before assembly.

Moreover, this is the only target system that utilizes a curved or radius shaped surface 40 as a rocker 12 in combination with optional counterweights 42, a sail 170, and wind powder to create random target movement.

The leveling feet 26 allow for use on uneven terrain while presenting the target in a realistic, level, orientation to the shooter. Also, inclination of the base 12 and/or the tracks can be adjusted to vary the required knock-down force, or the return characteristics or both. Additional counterweights can be provided to offset heavier target plates.

These and other modifications, methods and apparatus will become readily apparent from this application without departing from the scope of the invention and applicant intends to be bound only by the claims appended hereto.

What is claimed is:

1. A target apparatus comprising:

a base having a flat surface;

a rocker assembly comprising a curved surface operatively disposed in rolling engagement with the flat surface, and a target support coupled thereto for supporting a target thereon, said rocker assembly rolling on the flat surface in a first direction between an upright position and a lowered position, wherein said rocker assembly has a weight sufficient to return the rocker assembly to the upright position from the lowered position; and a braking assembly comprising a brake tab mounted on the base at a brake position and a stop pin mounted on the rocker assembly for movement away from and toward the brake position as the rocker assembly rocks between the upright position and the lowered position, and a retention nub extending from the curved surface, wherein the brake tab and the stop pin are configured to engage each other to stop the movement of the rocker assembly in the upright position, and the retention nub contacts the flat surface to stop the movement of the rocker assembly when the stop pin and brake tab are engaged.

2. The target apparatus of claim 1 wherein the rocker assembly comprises spaced apart rocker plates respectively defining a curved surface.

3. The target apparatus of claim 1 wherein the first direction is in alignment with a direction that runs from the back of the target apparatus to the front of the target apparatus.

4. The target apparatus of claim 1 wherein the first direction is perpendicular to a direction that runs from the back of the target apparatus to the front of the target apparatus.

5. The target apparatus of claim 4 further comprising a target and a sail coupled to at least one of the target support, a target post, the target, or the rocker assembly wherein the sail is configured to cause random movement of the target.

6. The target apparatus of claim 4 further comprising a push solenoid coupled to the base wherein said push solenoid is configured to apply a force to the rocker assembly thereby causing movement of the rocker assembly.

7. The target apparatus of claim 1 wherein the inclination of the flat surface is adjustable in the first direction for controlling the level of force required to roll the rocker assembly to the lowered position.

8. The target apparatus of claim 1 further including a latch system operably disposed to hold the rocker assembly with the target support in the lowered position.

9. The target apparatus of claim 8 wherein the latch system comprises an electronically controlled latch that selectively holds the rocker assembly in the lowered position.

10. The target apparatus of claim 9 wherein the target apparatus further includes a battery powered signal receiver for selectively receiving a signal from a remote transmitter and in response to said signal the latch system selectively releases the rocker assembly from the lowered position.

11. The target apparatus of claim 9 wherein the latch system includes an electro-magnet and a catch latch.

12. The target apparatus of claim 8 wherein the target apparatus further includes a mechanical latch release mechanism operably disposed to selectively release the rocker assembly from the lowered position.

13. The target apparatus of claim 1 wherein the target is a target plate operably disposed to transfer the ballistic force of a projectile to the rocker assembly thereby causing the rocker assembly to move from an upright position to a lowered position.

14. The target apparatus of claim 13 wherein the rocker assembly returns automatically returns to the upright position after reaching the lower position.

15. The target apparatus of claim 13 further comprising a latch system operably disposed to selectively hold the rocker assembly in the lowered position.

16. The target apparatus of claim 15 wherein the target apparatus further includes a battery powered signal receiver for selectively receiving a signal from a remote transmitter and in response to said signal the latch system selectively releases the rocker assembly from the lowered position.

17. The target apparatus of claim 1 further comprising a barrier coupled to the base.

18. The target apparatus of claim 1 wherein the base and rocker assembly is selectively configurable so that the first direction is either in alignment with a direction that runs from the back of the target apparatus to the front of the target apparatus or the first direction is perpendicular to the direction that runs from the back of the target apparatus to the front of the target apparatus.

19. A target apparatus comprising:

a base having a flat surface;

at least one of a target support, a target, or a target post;

a rocker assembly comprising a curved surface operatively disposed in rolling engagement with the flat surface, and the target support coupled thereto for supporting the target thereon, said rocker assembly rolling on the flat surface in a first direction between an upright position and a lowered position, wherein said rocker assembly has a weight sufficient to return the rocker assembly to the upright position from the lowered position and the first direction is perpendicular to a direction that runs from the back of the target apparatus to the front of the target apparatus; and a sail coupled to at least one of the target support, the target post, the target, or the rocker assembly;

wherein the sail is configured to cause random movement of the target.

20. A target apparatus comprising:

a base having a flat surface;

a rocker assembly comprising a curved surface operatively disposed in rolling engagement with the flat surface, and a target support coupled thereto for supporting a target thereon, said rocker assembly rolling on the flat surface in a first direction between an upright position and a lowered position, wherein said rocker assembly has a weight sufficient to return the rocker assembly to the upright position from the lowered position; and a latch system comprising an electronically controlled latch that selectively holds the rocker assembly in the lowered position.

* * * * *